US011274375B2

(12) United States Patent
Tuna et al.

(10) Patent No.: US 11,274,375 B2
(45) Date of Patent: Mar. 15, 2022

(54) TIN PLATING BATH AND A METHOD FOR DEPOSITING TIN OR TIN ALLOY ONTO A SURFACE OF A SUBSTRATE

(71) Applicant: Atotech Deutschland GmbH, Berlin (DE)

(72) Inventors: Kadir Tuna, Berlin (DE); Arnd Kilian, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 151 days.

(21) Appl. No.: 16/466,842

(22) PCT Filed: Dec. 20, 2017

(86) PCT No.: PCT/EP2017/083726
§ 371 (c)(1),
(2) Date: Jun. 5, 2019

(87) PCT Pub. No.: WO2018/122058
PCT Pub. Date: Jul. 5, 2018

(65) Prior Publication Data

US 2019/0345623 A1 Nov. 14, 2019

(30) Foreign Application Priority Data

Dec. 28, 2016 (EP) ..... 16207103

(51) Int. Cl.

| | |
|---|---|
| ***B22F 7/00*** | (2006.01) |
| ***C25D 3/32*** | (2006.01) |
| ***C23C 18/16*** | (2006.01) |
| ***C23C 18/48*** | (2006.01) |
| ***C23C 18/52*** | (2006.01) |
| *C09D 5/00* | (2006.01) |
| *C09D 5/10* | (2006.01) |
| *C23C 16/00* | (2006.01) |
| *C23C 18/00* | (2006.01) |

(52) U.S. Cl.
CPC ..... *C25D 3/32* (2013.01); *C23C 18/1658* (2013.01); *C23C 18/48* (2013.01); *C23C 18/52* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,917,486 | A | 11/1975 | Schneble, Jr. | |
| 2002/0104763 | A1 | 8/2002 | Yanada et al. | |
| 2005/0077186 | A1 | 4/2005 | Hansen et al. | |
| 2013/0206602 | A1 | 8/2013 | Lee et al. | |
| 2015/0159275 | A1 | 6/2015 | Kilian et al. | |
| 2016/0348259 | A1 | 12/2016 | Bronder et al. | |
| 2019/0345623 | A1 * | 11/2019 | Tuna | C23C 18/52 |

FOREIGN PATENT DOCUMENTS

| | | | | |
|---|---|---|---|---|
| CN | 1804142 | | 7/2006 | |
| CN | 103173807 | | 6/2013 | |
| CN | 104746052 | A | 7/2015 | |
| JP | 5368442 | B2 * | 12/2013 | C23C 18/52 |
| WO | 2008081637 | | 7/2008 | |
| WO | 2009157334 | | 12/2009 | |
| WO | WO-2009157334 | A1 * | 12/2009 | C23C 18/52 |

OTHER PUBLICATIONS

PCT/EP2017/083726; PCT International Search Report and Written Opinion of the International Searching Authority dated Feb. 5, 2018.
Office Action for Chinese Application No. 201780079427.7 dated Nov. 17, 2020.
Search Report for Taiwanese Application No. 106144797 dated Aug. 12, 2020.

* cited by examiner

*Primary Examiner* — James E McDonough
(74) *Attorney, Agent, or Firm* — Renner, Otto, Boisselle & Sklar, LLP

(57) ABSTRACT

The present invention concerns a tin plating bath comprising tin ions; at least one complexing agent selected from the group consisting of pyrophosphate ions, linear polyphosphate ions and cyclic polyphosphate ions and a nitrogen and sulfur containing stabilizing additive and titanium (III) ions as a reducing agent suitable to reduce tin ions to metallic tin. The present invention further discloses a method of depositing tin or a tin alloy onto a surface of a substrate. The tin plating bath is particularly suitable to be used in the electronics and semiconductor industry.

9 Claims, No Drawings

TIN PLATING BATH AND A METHOD FOR DEPOSITING TIN OR TIN ALLOY ONTO A SURFACE OF A SUBSTRATE

The present application is a U.S. National Stage Application based on and claiming benefit and priority under 35 U.S.C. § 371 of International Application No. PCT/EP2017/083726, filed 20 Dec. 2017, which in turn claims benefit of and priority to European Application No. 16207103.9 filed 28 Dec. 2016, the entirety of both of which is hereby incorporated herein by reference.

FIELD OF THE INVENTION

The present invention relates to a tin plating bath, in particular to an electroless (autocatalytic) tin plating bath, and a method for depositing tin or tin alloy onto at least one surface of at least one substrate.

BACKGROUND OF THE INVENTION

Deposits of tin and tin alloys on electronic parts such as printed circuit boards, IC substrates and semiconductor wafers are used inter alia as solderable and bondable finishes in later manufacturing steps of such electronic parts.

The tin and tin alloy deposits are usually formed on metallic contact areas such as contact pads and bump structures. The contact areas are usually made of copper or copper alloys. In case such contact pads can be electrically contacted for deposition of tin and tin alloy layers such layers are deposited by conventional electroplating methods. However, in many cases the individual contact areas cannot be electrically contacted. In such cases an electroless plating method needs to be applied. The method of choice in the industry for electroless plating of tin and tin alloy layers used to be immersion plating. The main disadvantage of immersion type plating is the limited thickness of the tin or tin alloy deposit. Immersion plating is based on an exchange between tin ions and the metallic copper contact area to be plated. With immersion type plating of tin or tin alloy layers the deposition rate decreases strongly with increasing tin layer thickness, since the exchange of copper against tin is hindered by the growing tin layer.

Typically, tin is deposited with thiourea as complexing agent in such immersion type plating baths. However, thiourea has several disadvantages. First, it dissolves metal ions from surface to be plating, in particular copper from cuprous surfaces forming an insoluble sludge, and second, it is carcinogenic. Attempts to replace it have been widely unsuccessful to date. Moreover, immersion plating bath always show a loss of plating rate over time as the plating bath loses access to the surface which is to be plated and thus the plating process eventually ceases. Thus, new concepts of tin or tin alloy deposition are required to meet today's industry demands. Another complexing agent used widely is cyanide which is also problematic because of its toxicity and for ecological reasons.

In situations where a thicker layer of tin or a tin alloy layer is desired and an electrical connection cannot be provided, an autocatalytic type electroless plating process is required. Plating bath compositions for autocatalytic plating of tin or tin alloys comprise a (chemical) reducing agent.

US 2005/077186 A1 discloses an acidic electrolytic tin plating bath comprising an aliphatic complexant having a sulfide group and an amino group which are linked to different carbon atoms. Also, such sulfur compounds are used in electrolytic bronze plating (DE 10 2013 226 297 B3 and EP 1 001 054 A2) and electrolytic tin plating as described in CN 1804142 A as well as CN 103173807 A.

An autocatalytic tin plating bath comprising a water-soluble tin compound, a water-soluble titanium compound and an organic complexing agent containing trivalent phosphorus is disclosed in WO 2008/081637 A1.

WO 2009/157334 A1 relates to electroless tin plating baths comprising organic complexing agents and organic sulfides. However, the plating baths disclosed show a quick loss of plating rate over time and results in low overall plating rates (see comparative examples). This is a major drawback of many tin plating baths, in particular electroless tin plating baths, known in the art.

GB 1,436,645 discloses an immersion tin plating bath comprising a mineral acid and a sulfur component such as thiourea or metal polysulfides.

Typically, conventional tin plating baths show a plating behavior that starts with a very high plating rate which then decreases significantly over time of use. In some cases, the plating rates gives a sharp peak within the first minutes to then drop all the quicker. Such behavior is highly undesired as it makes it very difficult to control the plating outcome such as tin deposit homogeneity and thickness.

OBJECTIVE OF THE PRESENT INVENTION

It is therefore an objective of the present invention to overcome the shortcomings of the prior art. It is another objective to provide a tin plating bath having an improved plating rate compared to electroless tin plating baths known from the prior art.

It is a further objective to provide a tin plating bath (sufficiently) stable against plate-out (e.g. for at least 1 h after make-up or during use).

SUMMARY OF THE INVENTION

Above-named objectives are solved by the inventive tin plating bath which comprises (a) tin ions;

(b) at least one complexing agent selected from the group consisting of pyrophosphate ions, linear polyphosphate ions and cyclic polyphosphate ions;

(c) at least one stabilizing additive (independently) selected from the group consisting of nitrogen-containing organic thiol compounds and nitrogen-containing organic disulfide compounds; and (d) titanium (III) ions as reducing agent suitable to reduce tin ions to metallic tin.

Above-named objectives are further solved by the use of the tin plating bath according to the invention for depositing tin or tin alloy onto at least one surface of a substrate and the method for depositing tin or tin alloy onto at least one surface of at least one substrate comprising the method steps (i) providing the substrate; and (ii) contacting at least one surface of the substrate with the inventive tin plating bath according to the invention such that a tin or tin alloy is deposited on the at least one surface of the substrate.

Advantageously, the inventive tin plating bath shows a minimal or no loss of plating rate over time, in particular within the first 15 or 30 min of use. Further, the inventive tin plating bath allows for homogeneous tin or tin alloy deposits to be formed. There is no or very little dependence of the layer thickness of the tin or tin alloy deposits if two or more surfaces of different size areas are plated simultaneously. When using conventional plating baths to deposit tin simultaneously on substrates with different size areas, the plating typically results in inhomogeneously covered surfaces (in particular in terms of tin or tin alloy deposit thickness). The disadvantage of conventional tin plating baths that, typically, larger surface areas resulted in thinner deposits compared to smaller surface areas has been overcome by the present invention.

It is a further advantage of the present invention that tin plating baths with a significantly higher plating rate can be provided (see e.g. inventive examples 1 and 2 compared to comparative examples 1 and 2).

It is yet another advantage of the present invention that a tin plating bath having a sufficiently initial high plating rate (e.g. after 5 min) and a sufficiently high plating rate during use (e.g. after 15 min or 30 min) is provided.

It is another advantage of the present invention that glossy tin deposits can be provided, without the need of an organic gloss agent or a surfactant. The tin deposits are further free of visible detectable defects such as burnings or blisters.

DETAILED DESCRIPTION OF THE INVENTION

Percentages throughout this specification are weight-percentages (wt.-%) unless stated otherwise. Yields are given as percentage of the theoretical yield. Concentrations given in this specification refer to the volume or mass of the entire solutions unless stated otherwise. The terms "deposition" and "plating" are used interchangeably herein.

The term "alkyl group" according to the present invention comprises branched or unbranched alkyl groups comprising cyclic and/or non-cyclic structural elements, wherein cyclic structural elements of the alkyl groups naturally require at least three carbon atoms. C1-CX-alkyl group in this specification and in the claims refers to alkyl groups having 1 to X carbon atoms (X being an integer). C1-C8-alkyl group for example includes, among others, methyl, ethyl, n-propyl, iso-propyl, n-butyl, iso-butyl, sec-butyl, tert-butyl, n-pentyl, iso-pentyl, sec-pentyl, tert-pentyl, neo-pentyl, hexyl, heptyl and octyl. Substituted alkyl groups may theoretically be obtained by replacing at least one hydrogen by a functional group. Unless stated otherwise, alkyl groups are preferably selected from substituted or unsubstituted C1-C8 alkyl groups, more preferably from substituted or unsubstituted C1-C4 alkyl groups because of their improved water-solubility.

The term "aryl group" according to the invention refers to ring-shaped aromatic hydrocarbon residues, for example phenyl or naphtyl where individual ring carbon atoms can be replaced by N, O and/or S, for example benzothiazolyl. Furthermore, aryl groups are optionally substituted by replacing a hydrogen atom in each case by a functional group. The term C5-CX-aryl group refers to aryl groups having 5 to X carbon atoms (optionally replaced by N, O and/or S) in the ring-shaped aromatic group.

The term "alkanoyl group" according to the invention refers to a hydrocarbon residue consisting of at least one alkyl group and a carbonyl group (—C(O)—). Typically, the alkanoyl group is bound by the carbonyl group. An example of an alkanoyl group is the acetyl group (—C(O)—$CH_3$). Similarly, an "aroyl group" consists of an aryl group and a carbonyl group. An example of an aroyl group is the benzoyl group (—C(O)-Ph).

Unless stated otherwise, above-described groups are substituted or unsubstituted. Functional groups as substituents are preferably selected from the group consisting of hydroxyl, amino and carboxyl to improve the water-solubility of the treatment additives. If more than one residue is to be selected from a certain group, each of the residues is selected independently from each other unless stated otherwise hereinafter. Asterisks in chemical formulae are intended to highlight bonding sites, i.e. a chemical bond ending in an asterisk means that is bonded to another entity (represented by the asterisk).

Advantageously, the inventive tin plating bath has a loss of plating rate over time which is minimized compared to a conventional tin plating bath known in the art. Ideally, the inventive tin plating bath allows for a constant plating rate, at least for a certain period of time.

A tin plating bath whose loss of plating rate over time is minimized, and ideally a tin plating bath with constant plating rate, allows for improved process control as the tin deposit thickness can easily be controlled. This eliminates the necessity of tedious optimizations if the deposition of certain tin deposit thicknesses is desired. Further, tin deposits formed at a constant plating rate are much more homogeneous (in particular in terms of tin or tin alloy deposit thickness) compared to deposits from plating baths with varying plating rates. It is thus highly desired to provide a tin plating bath with a constant plating rate.

The inventive tin plating bath comprises tin ions. Typical sources of the tin ions are water-soluble tin salts or water-soluble tin complexes. Preferably, the tin ions are tin(II) ions facilitating the reduction to their metallic state (compared to tin(IV) ions). More preferably, the at least one source of the tin ions is selected from the group consisting of organic sulfonates of tin in the oxidation state+II such as tin (II) methane sulfonate; tin (II) sulfate; tin (II) halides such as tin (II) chloride, tin (II) bromide; tin (II) pyrophosphate; linear tin (II) polyphosphate; cyclic tin (II) polyphosphate and mixtures of the aforementioned. Even more preferably, the at least one source of the tin ions is selected from the group consisting of tin (II) pyrophosphate, linear tin (II) polyphosphate, cyclic tin (II) polyphosphate and mixtures of the aforementioned to avoid undesired further anions in the tin or tin alloy plating. Alternatively and preferably, the tin ions can be prepared by anodic dissolution of metallic tin.

The total concentration of tin ions in the inventive tin plating bath preferably ranges from 0.02 to 0.2 mol/L, more preferably from 0.04 to 0.09 mol/L and even more preferably from 0.05 to 0.07 mol/L. Concentrations outside above thresholds are applicable depending on the circumstances. However, if the concentrations are below said thresholds longer plating times may be required and concentrations above said thresholds in some case may lead to plate-out.

The inventive tin plating bath further comprises at least one stabilizing additive selected from the group consisting of nitrogen-containing organic thiol compounds and nitrogen-containing organic disulfide compounds. The at least one stabilizing additive contains at least one nitrogen atom and at least one sulfur atom forming the thiol moiety or the disulfide moiety. The sulfur atom forming the thiol moiety or sulfur atoms forming the disulfide moiety is bound to a carbon atom of a hydrocarbon group (e.g. an alkyl group, an alkanediyl group, an aryl group or a arenediyl group) which also binds to the at least one nitrogen atom.

Preferably, the at least one stabilizing additive is selected from the group consisting of compounds according to formula (I)

(I)

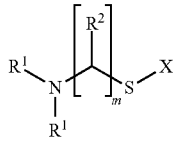

wherein m is integer ranging from 1 to 3;

each $R^1$ is independently selected from hydrogen, alkyl group, aryl group, alkanoyl group and aroyl group;

each $R^2$ is independently selected from hydrogen, alkyl group, aryl group and carboxyl group (—$CO_2H$);

X is selected from hydrogen and (Ia)

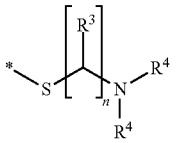

with each $R^3$ being independently selected from hydrogen, alkyl group, aryl group and carboxyl group;

each $R^4$ being independently selected from hydrogen, alkyl group, aryl group, alkanoyl group and aroyl group; and n being an integer ranging from 1 to 3;

compounds according to formula (II)

(II)

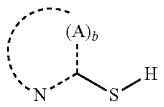

wherein each A is independently selected from the group consisting of carbon atom, nitrogen atom and sulfur atom;

b is an integer ranging from 3 to 4;

the carbon atom (depicted in formula (II); this carbon atom is linked to the thiol group and located between the nitrogen atom and A), all A and N in formula (II) form a substituted or unsubstituted ring;

wherein said ring (the ring formed by the carbon atom, all A and N depicted in formula (II)) is further annulated with a further ring, which is substituted or unsubstituted, saturated or unsaturated, or said ring (the ring formed by the carbon atom, all A and N depicted in formula (II)) is not annulated with any further rings;

and wherein said ring (the ring formed by the carbon atom, all A and N depicted in formula (II)) is saturated or unsaturated.

Compounds according to formulae (I) and (II) both are organic nitrogen-containing thiol compounds or organic nitrogen-containing disulfide compounds sharing as common structural motif the presence at least one nitrogen atom and at least one sulfur atom bound by one hydrocarbon group.

Preferably, each $R^1$ in the compounds according to formula (I) is independently selected from hydrogen and alkanoyl group. Preferably, each $R^2$ in the compounds according to formula (I) is independently selected from hydrogen and carboxyl group. Preferably, $R^3$ in formula (Ia) in the compounds according to formula (I) is independently selected from hydrogen and carboxyl group. Preferably, each $R^4$ in formula (Ia) in the compounds according to formula (I) is independently selected from hydrogen and alkanoyl group. Preferably, n in the compounds according to formula (I) is 2. Preferably, m in the compounds according to formula (I) is 2. Preferably, in the case when X is selected to be (Ia) forming a of nitrogen-containing organic disulfide compound according to formula (I), $R^1$ and $R^2$ of (I) and $R^3$ and $R^4$ of (Ia) are selected to be the same for the ease of synthesis.

More preferably, $R^3$ is independently selected from hydrogen and carboxyl group, each $R^4$ is independently selected from hydrogen and alkanoyl group; and n is 2. Even more preferably, the compounds according to formula (I) are selected from the group consisting of cysteamine, cystamine, cystine, cysteine and mixtures of the aforementioned. Compounds according to formula (I) appear to allow for particularly high plating rates.

In compounds according to formula (II), the sulfur atom (which is depicted as such in formula (II)) is bound via a carbon atom which also bears the nitrogen atom (which is depicted as such in formula (II)). The compounds according to formula (II) comprise at least one exocyclic sulfur atom.

The substituted or unsubstituted ring formed by the carbon atom, all A and N in formula (II) is a five- or six-membered ring. The substituted or unsubstituted ring formed by the carbon atom, all A and N in formula (II) is preferably unsaturated, more preferably aromatic resulting in improved plating rate constancies.

The ring formed by the carbon atom, all A and N in formula (II) may be annulation with a further ring, which is substituted or unsubstituted. Said further ring is saturated or unsaturated, preferably unsaturated, more preferably aromatic, even more preferably the respective benzene derivative (thus forming a benzannulated ring with the ring formed by the carbon atom, all A and N in formula (II) such as benzothiazole). In particular, the substituted or unsubstituted ring formed by the carbon atom, all A and N in formula (II) is a five- or six-membered ring or a benzannulated derivative thereof.

Preferably, the A next to the carbon atom bearing the exocyclic thiol group and the nitrogen atom depicted in formula (II) is selected from the group consisting of carbon atoms and sulfur atoms. This in some cases results in improved plating rate constancy. More preferably, the A next to the carbon atom bearing the exocyclic thiol group and the nitrogen atom depicted in formula (II) is selected from the group consisting of carbon atoms and sulfur atoms and all other A are selected to be carbon atoms. In one embodiment of the present invention, all or all but one A are selected to be carbon atoms.

More preferably, the substituted or unsubstituted ring formed by the carbon atom, all A and N in formula (II) is selected from the group consisting of pyrrole, imidazole, triazole, tetrazole, pyridine, pyridazine, pyrimidine, pyrazine, triazine, thiazoline, thiazole, thiazine, thiadiazole and the benzannulated derivatives of the aforementioned such as benzothiazole, benzimidazole, indole and the like.

Even more preferably, the compounds according to formula (II) are selected from the group consisting of 2-mercaptopyridine, 2-mercaptobenzothiazole, 2-mercapto-2-thiazoline and mixtures of the aforementioned. Compounds according to formula (II) appear to allow for particularly constant plating rates.

In one preferred embodiment of the present invention, the at least one stabilizing agent is selected from the group consisting of cysteamine, cystamine, cystine, cysteine, 2-mercaptopyridine, 2-mercaptobenzothiazole, 2-mercapto-2-thiazoline and mixtures of the aforementioned.

The compounds above may be used as sole stabilizing additives or as mixtures of two or more of said compounds which are independently selected from the aforementioned. In one embodiment of the present invention the at least one stabilizing additive is a compound according to formula (I). In another embodiment of the present invention the at least one stabilizing additive is at least one compound according to formula (II). In yet another embodiment of the present invention the at least one stabilizing additive is at least one compound according to formula (I) and at least one compound according to formula (II).

The total concentration of all stabilizing additives in the inventive tin plating bath preferably ranges from 0.5 to 100 mmol/L, more preferably from 1 to 20 mmol/L, even more preferably from 5 to 10 mmol/L and yet even more preferably from 6 to 8 mmol/L. Concentrations outside above thresholds are applicable depending on the circumstances. However, if the concentrations are below said thresholds the positive effects of the present invention may not be pronounced enough and concentrations above said thresholds in some case do not add further to the benefits while only increasing the cost.

The inventive tin plating bath further comprises at least one complexing agent (also referred to as chelating agent in the art) selected from the group consisting of pyrophosphate ions, linear polyphosphate ions and cyclic polyphosphate ions. Mixtures of two or more of said complexing agents may suitably be used. Suitable sources for pyrophosphate ions, linear polyphosphate ions and cyclic polyphosphate ions are the respective water-soluble compounds and complexes such as salts and acids. Preferable sources are the respective salts such as alkaline salts (e.g. sodium, potassium), hydrogen salts (e.g. hydrogen sodium pyrophosphate), ammonium salts, and the respective acids such as pyrophosphoric acid, tripolyphosphoric acid and trimetalphosphoric acid and mixtures of the aforementioned.

The total concentration of all complexing agents in the inventive tin plating bath preferably ranges from 0.1 to 3.5 mol/L, more preferably from 0.1 to 2 mol/L and even more preferably from 0.15 to 1.5 mol/L, yet even more preferably from 0.2 to 1.2 mol/L and still more preferred from 0.25 to 1.0 mol/L and most preferred from 0.5 to 1.0 mol/L. Concentrations outside above thresholds are applicable depending on the particular circumstances. However, if the concentrations are below said thresholds the stability of the inventive tin plating bath may be insufficient resulting in plate-out and concentrations above said thresholds in some cases may lower the plating rate of the inventive tin plating bath. Complexing agents fulfill various functions in the inventive tin plating bath. They firstly exert a buffering action of the pH of the bath. Secondly, they prevent the precipitation of the tin ions and thirdly, reduce the concentration of free (i.e. tin ions which are not complexed) tin ions. In particular, because of the two last named reasons, it is a preferred embodiment of the present invention, that the at least one complexing agent is used in a molar excess with respect to the tin ions. Preferably, the molar ratio of all complexing agents selected from the group consisting of pyrophosphate ions, linear polyphosphate ions and cyclic polyphosphate ions to the tin ions is at least 1 to 1. More preferably, the molar ratio of all complexing agents selected from the group consisting of pyrophosphate ions, linear polyphosphate ions and cyclic polyphosphate ions to the tin ions ranges from 2/1 to 25/1, even more preferably from 2.5 to 20/1, still even more preferably 5/1 to 15/1, most preferably from 7.5/1 to 12.5/1.

The inventive tin plating bath is an electroless (autocatalytic) tin plating bath. The terms "electroless tin plating bath" and "autocatalytic tin plating bath" are used interchangeably herein. In the context of the present invention, electroless plating is to be understood as autocatalytic deposition with the aid of a (chemical) reducing agent (referred to as "reducing agent" herein). It is to be distinguished between electroless and immersion plating baths. The latter do not require the addition of a (chemical) reducing agent but rely on the exchange of metal ions in the bath with metallic components from the substrate, e.g. copper (vide supra). There is thus a fundamental difference between those two types of plating baths.

The inventive electroless tin plating bath thus comprises at least one reducing agent suitable to reduce tin ions to metallic tin. Titanium (III) ions are used as the at least one reducing agent. Titanium (III) ions may be added as water-soluble titanium (III) compounds. The preferred titanium (III) compounds are selected from the group consisting of titanium (III) chloride, titanium (III) sulfate, titanium (III) iodide, and titanium(III) methane sulfonate. Alternatively, the inventive tin plating bath can be made up with a source of titanium (IV) ions or a mixture of titanium (III) and titanium (IV) ions and activated before use by electrochemically reducing the titanium (IV) ions to titanium (III) ions as described in U.S. Pat. No. 6,338,787. In particular, a regeneration cell as described in WO 2013/182478 A2, e.g. in FIG. 1 therein, and the method described by said document are also useful for this purpose.

The total concentration of all reducing agents in the inventive electroless (autocatalytic) tin plating bath preferably ranges from 0.02 mol/L to 0.2 mol/L, more preferably from 0.04 mol/L to 0.15 mol/L and even more preferably from 0.05 to 0.08 mol/L.

The inventors have surprisingly found that the combination of above complexing agents with the stabilizing additives described hereinbefore allow for the beneficial effects described in this specification such as maintenance of the plating rate of the inventive tin plating bath during use and over time. Further, said combination allows for higher plating rates to be obtained after 5 min or 10 min or 20 min or 30 min of use compared to other stabilizing additives and/or complexing agents.

The inventive tin plating bath is an aqueous solution. This means that the prevailing solvent is water. Other solvents which are miscible with water such as polar organic solvents including alcohols, glycols and glycol ethers are optionally added. For its ecologically benign characteristics, it is preferred to use water only (i.e. more than 99 wt.-% based on all solvents, more preferably more than 99.9 wt.-% based on all solvents).

The inventive tin plating bath usually has a neutral or alkaline pH value. The pH value of the inventive tin plating bath is therefore usually 7 or higher. The pH value of the inventive tin plating bath preferably ranges from 7 to 9, more preferably from 7.5 to 8.5 and even more preferably from 8.0 to 8.3. These pH ranges allow for stable tin plating baths with improved maintenance of the plating rate or, ideally, with constant plating rates.

Optionally, the inventive tin plating bath comprises at least one pH adjustor. Said pH adjustor is an acid, a base or a buffer compound. Preferable acids are selected from the group consisting of inorganic acids and organic acids. Inorganic acids are preferably selected from the group consisting of phosphoric acid, hydrochloric acid, sulfuric acid, nitric acid, and mixtures of the aforementioned. Organic acids are typically carboxylic acids such as formic acid, acetic acid, malic acid, lactic acid and the like and mixtures of the aforementioned. Buffer compounds are preferably boric acid and/or phosphate based buffers. The at least one pH adjustor is typically used in concentrations to adjust the pH value of the inventive tin plating bath to said ranges.

Optionally, the inventive tin plating bath comprises at least one further type of reducible metal ions other than tin ions. The term "reducible metal ions" is to be understood in the context of the present invention as metal ions which can be reduced to their respective metallic state under the given conditions (e.g. typical plating conditions and in particular the conditions outlined in this specification). Exemplarily, alkaline metal ions and earth alkaline metal ions typically cannot be reduced to their respective metallic state under the conditions applied. If such further type of reducible metal ions other than tin ions is present in the tin plating bath, a tin alloy will be deposited when using the inventive tin plating bath. Typical tin alloys used as solderable or bondable finishes on contact areas are tin-silver alloys, tin-bismuth alloys, tin-nickel alloys and tin-copper alloys. Suitable further types of reducible metal ions other than tin ions are thus preferably selected from the group consisting of silver ions, copper ions, bismuth ions and nickel ions.

A source of optional silver ions, bismuth ions, copper ions and nickel ions is selected from water-soluble silver, bismuth, copper and nickel compounds. The preferred water-soluble silver compound is selected from the group consisting of silver nitrate, silver sulfate, silver oxide, silver acetate, silver citrate, silver lactate, silver phosphate, silver pyrophosphate and silver methane sulfonate. The preferred water-soluble bismuth compound is selected from the group consisting of bismuth nitrate, bismuth oxide, bismuth methane sulfonate, bismuth acetate, bismuth carbonate, bismuth chloride and bismuth citrate. The preferred water-soluble copper compound is selected from the group consisting of copper sulfate, copper alkylsulfonate such as copper methane sulfonate, copper halides such as copper chloride, copper oxide and copper carbonate. The preferred source of water-soluble nickel compound is selected from the group consisting of nickel chloride, nickel sulfate, nickel acetate, nickel citrate, nickel phosphate, nickel pyrophosphate and nickel methane sulfonate.

The concentration of the at least one further type of reducible metal ions other than tin ions preferably ranges from 0.01 g/L to 10 g/L, more preferably from 0.02 g/L to 5 g/L.

In one embodiment of the present invention, the inventive tin plating bath is substantially free of further reducible metal ions other than tin ions. This means that the amount of further reducible metal ions is 1 mol-% or less based on the amount of tin ions. Preferably, only tin ions as reducible metal ions are present in the tin plating bath. Then, pure tin will be deposited by using the tin plating bath.

Preferably, the inventive tin plating bath is free of organophosphorus compounds such as nitrilotris(methylene phophonate) (NTMP), particularly of organophosphorus compounds wherein the phosphorus atoms in said compounds are in the oxidation state +III. The inventors have found that these compounds occasionally have a negative influence on the plating rate and increase the loss of plating rate over time and during use of a tin plating bath containing such organophosphorus compounds.

Preferably, the inventive tin plating bath preferably is free of thiourea because of its acute toxicity and its tendency to dissolve metals ions from a metallic surface, e.g. copper ions from a cuprous surface. Thiourea further increases the loss of plating rate over time and during use of a tin plating bath containing said compound.

Preferably, the inventive tin plating bath preferably is free of cyanide ions ($CN^-$) because of the toxicity thereof. In one embodiment of the present invention, the inventive tin plating bath comprises only complexing agents selected from the group consisting of pyrophosphate ions, linear polyphosphate ions and cyclic polyphosphate ions.

Preferably, the inventive tin plating bath preferably is free of polysulfides such as alkaline polysulfides to avoid hydrogensulfide liberation.

Optionally, the inventive tin plating bath comprises at least one antioxidant. The at least one antioxidant advantageously inhibits the oxidation of tin (II) ions to tin (IV) ions. The at least one antioxidant is preferably a hydroxylated aromatic compound such as catechol, resorcinol, hydroquinone, pyrogallol, □- or □-naphthol, phloroglucinol or a sugar-based compound such as ascorbic acid and sorbitol. Said antioxidants are typically used in a total concentration of 0.1 to 1 g/L.

Optionally, the inventive tin plating bath comprises at least one surfactant. The at least one surfactants improves the wetting of the substrate with the inventive tin plating bath and thus facilitates the tin deposition. It further helps to deposit smooth tin deposits. Useful surfactants can be determined by the person skilled in the art by routine experiments. Said surfactants are typically used in a total concentration of 0.01 to 20 g/L.

The inventive tin plating bath may be prepared by dissolving all components in at least one solvent, preferably in water for the reasons outlined hereinbefore. An alternative preparation method which is particularly useful is as follows:

Firstly, a solution of tin(II) ions and complexing agent in a solvent is prepared, preferably in water. Secondly, a solution comprising complexing agent and titanium (IV) salts, typically titanium (IV) alkoxylates because of their solubility, is acidified with an (preferably inorganic) acid such as phosphoric acid. Said solution is then subjected to elevated temperatures to remove all volatile components such as alcohols and the like. A subsequent reduction, preferably electrolytically using a constant cathodic current, of the titanium (IV) ions to titanium (III) ions is followed by mixing the two aforementioned solutions and addition of the further components such as the stabilizing additives.

In method step (i) of the method according to the invention the substrate is provided. The substrate has at least one surface suitable to be treated with the inventive tin plating bath. Preferably, said at least one surface is selected from surfaces comprising copper, nickel, cobalt, gold, palladium, tungsten, tantalum, titanium, platinum alloys and mixtures of any of the aforementioned. The surfaces consist of the aforementioned materials or only comprise the aforementioned, preferably in an amount of at least 50 wt.-%, more preferably of at least 90 wt.-%. The substrates are made in their entirety of the materials listed above or they only comprise one or more surfaces made of the materials listed above. It is also possible within the meaning of the present invention to treat more than one surface simultaneously or subsequently.

More preferably, the at least one surface is selected from the group consisting of surfaces comprising (or consisting of) copper, nickel, cobalt, gold, palladium, platinum, alloys and mixtures of any of the aforementioned.

In particular, substrates typically employed in the electronics and semiconductor industry having one or more of above-described surfaces are used in the method according to the invention. Such substrates include inter alia printed circuit boards, IC substrates, flat panel displays, wafers, interconnect devices, ball grid arrays and the like.

Optionally, the at least one substrate is subjected to one or more pre-treatment steps. Pre-treatment steps are known in the art. The pre-treatment steps can be for example cleaning steps, etching steps and activation steps. Cleaning steps typically use aqueous solutions comprising one or more surfactants and are used to remove contaminants, e.g. from the at least one surface of the at least one substrate which are detrimental to the tin plating deposition. Etching steps usually employ acidic solutions, optionally comprising one or more oxidant such as hydrogen peroxide, to increase the surface area of the at least one surface of the at least one substrate. Activation steps usually require the deposition of a noble metal catalyst, most often palladium, on the at least one surface of the at least one substrate to render said at least one surface more receptive for tin deposition. Sometimes an activation step is preceded by a pre-dip step or succeeded by a post-dip step, both which are known in the art.

In method step (ii) of the method according to the invention, the at least one surface to be treated of the substrate is contacted with the inventive tin plating bath. By contacting the at least one surface of the substrate with the inventive tin plating bath, tin or a tin alloy is deposited on the at least one surface of the at least one substrate.

The inventive tin plating bath is preferably contacted to the respective surface by immersion, dip-coating, spin-coating, spray-coating, curtain-coating, rolling, printing, screen printing, ink-jet printing or brushing. In one embodiment of the present invention, the inventive tin plating bath is used in horizontal or vertical plating equipment.

The contacting time of the at least one surface with the inventive tin plating bath preferably ranges from 1 min to 4 h, more preferably from 15 min to 2 h and even more preferred from 30 min to 1 h Contacting times outside above thresholds are possible if particularly thin or thick tin or tin alloys deposits are required. The preferred thickness of the tin or tin alloy deposit ranges from 1 to 30 μm, preferably from 2 to 20 μm and more preferably from 4 to 10 μm.

The application temperature depends on the method of application used. For example, for dip, roller or spin coating applications, the temperature of application typically ranges between 40 and 90° C., preferably between 50 and 85° C. and even more preferred between 65 and 75° C.

Optionally, the inventive tin plating bath may be regenerated. Regeneration of the tin plating bath is exemplarily used to reduce the titanium (IV) ions to the titanium (III) ions. A useful method and a suitable apparatus for this purpose are described inter alia in EP 2 671 968 A1.

The components in the inventive tin plating bath may optionally be replenished, e.g. by anodic dissolution of metallic tin or by addition of above-named components either as such or in solution.

Optionally, the tin or tin alloy deposit is post-treated with an anti-tarnish composition which is known in the art.

The inventive method optionally comprises one or more rinsing steps. Rinsing can be accomplished by treatment of the at least one surface of the at least one substrate with at least one solvent, said at least one solvent optionally comprising one or more surfactants. The at least one solvent is preferably selected from the group consisting of water, more preferably deionized water (DI water), alcohols such as ethanol and iso-propanol, glycols such as DEG and glycol ethers such as BDG and mixtures of the aforementioned.

The inventive method optionally further comprises drying steps. Drying can be done by any means known in the art such as subjecting the substrate to elevated temperature and/or air drying.

The present invention further concerns products manufactured with the inventive method or with the inventive tin plating bath. In particular, it concerns printed circuit boards, IC substrates, flat panel displays, wafers, interconnect devices, ball grid arrays comprising at least one tin or tin alloy deposit formed with the inventive tin plating bath and/or the inventive method.

The invention will now be illustrated by reference to the following non-limiting examples.

EXAMPLES

Products were used (concentrations, parameters, further derivatives) as described in the corresponding technical datasheets (as available at the date of filing) unless specified differently hereinafter. A plating rate of at least 2 μm/h is usually required for practical applications.

Determination of thickness of the metal or metal alloy deposits: The deposit thickness was measured at 10 positions of each substrate and is used to determine the layer thickness by XRF using the XRF instrument Fischerscope XDV-SDD (Helmut Fischer GmbH, Germany). By assuming a layered structure of the deposit, the layer thickness can be calculated from such XRF data. Alternatively, the thickness of deposits was determined from a frequency change in a quartz crystal with a quartz crystal microbalance (SRS QCM200, Stanford Research Systems, Inc.).

Measurements of plating rate: The plating rate was obtained by dividing the thickness of the tin deposit by the time necessary to obtain said thickness.

pH values were measured with a pH meter (SevenMulti S40 professional pH meter, electrode: InLab Semi-Micro-L, Mettler-Toledo GmbH, ARGENTHAL™ with $Ag^+$-trap, reference electrolyte: 3 mol/L KCl) at 25° C. The measurement was continued until the pH value became constant, but in any case at least for 3 min. The pH meter was calibrated with three standards for high pH values at 7.00, 9.00 and 12.00 supplied by Merck KGaA prior to use.

In some of the following examples, a regeneration cell was used. The regeneration cell used in the following examples is disclosed in WO 2013/182478, FIG. 1 therein.

Inventive Example 1

2-Mercaptopyridine as Stabilizing Additive in an Electroless Tin Plating Bath 1) In a beaker 99.1 g/L potassium pyrophosphate were dissolved in deionized water. Then, 41.14 g/L tin(II) pyrophosphate were added. The resulting solution was stirred at 50° C. for 30 min to dissolve the tin(II) pyrophosphate followed by filtration and cooling to 25° C. The pH value of the solution was about 8.1.
2) In a further beaker, 330.34 g/L (1 mol/L) potassium pyrophosphate and 39.17 g/L (0.4 mol/L) 85 wt.-% ortho-phosphoric acid were dissolved in deionized water prior to heating the solution to 85° C. Then, 28.42 g/L (0.1 mol/L) titanium(IV)iso-propoxide were added slowly resulting in a pH value of about 7.8-7.9. The solution was then subjected to elevated temperature until the white precipitate was completely dissolved and the iso-propanol was removed. The solution was filtered and placed in a regeneration cell where a constant cathodic current was applied to said solution (I=20 A) yielding Ti(III) ions. After that treatment, the solution contained 0.9 mol/L Ti(III) ions and 0.1 mol/L Ti(IV) ions.

The two solutions described above were used to prepare an inventive tin plating bath comprising the following components:

c ($Sn^{2+}$)=45 mmol/L
c ($Ti^{3+}$)=40 mmol/L
c ($Ti^{4+}$)=4.5 mmol/L
c (pyrophosphate)=535 mmol/L
c (2-mercaptopyridine)=6 mmol/L
pH=8.2

A ball grid array having a plurality of copper surfaces with differing sizes was then immersed into the inventive tin plating bath at 70° C. for 30 min. The thickness of the tin deposits was measured by XRF. The results are summarized in Table I.

Inventive Example 2

Cysteamine as Stabilizing Additive in an Electroless Tin Plating Bath

The method described for inventive example 1 was repeated but 2-mercaptopyridine was substituted for 1 mmol/L cysteamine. The results are summarized in Table I.

Comparative Example 1

No Stabilizing Additive in an Electroless Tin Plating Bath

The method described for inventive example 1 was repeated but 2-mercaptopyridine was omitted. Thus, no stabilizing additive was used in this example. The results are summarized in Table I.

TABLE I

Tin deposit thickness in dependence of stabilizing additive.

| # | stabilizing additive | thickness of tin deposit [μm] |
|---|---|---|
| C1 | Comparative example 1: no stabilizing additive | 0.2 |
| 1 | Inventive example 1: 2-mercaptopyridine | 1.8 |
| 2 | Inventive example 2: cysteamine | 1.3 |

The tin deposits obtained from inventive examples 1 and 2 were glossy and free of visually detectable defects such as blisters, burnings and the like. By using the stabilizing additives in the electroless tin plating bath, the plating rate was significantly improved compared to comparative example C1. Interestingly, inventive example using only 1 mmol/L of the stabilizing additive according to formula (I) showed almost as high a plating rate increase as inventive example 1 using a 6 times higher concentration of a stabilizing additive according to formula (II). Both inventive tin plating bath were stable and did not show any plate-out while depositing tin.

Comparative Example 2

NTMP Instead of Pyrophosphate as Complexing Agent in an Electroless Tin Plating Bath (Method According to WO 2009/157334 A1)

10 g/L tin (II) ions (provided as tin(II) chloride), 50 g/L titanium (III) chloride, 50 g/L nitrilotris(methylene phophonate) (NTMP) and 100 mg/L 2-mercaptopyridine were dissolved in deionized water. The solution almost instantly formed precipitates (independent on the order of addition of the individual components) making it impossible to use it for any plating experiments.

Other embodiments of the present invention will be apparent to those skilled in the art from a consideration of this specification or practice of the invention disclosed herein. It is intended that the specification and examples be considered as exemplary only, with the true scope of the invention being defined by the following claims only.

The invention claimed is:

1. An electroless tin plating bath comprising (a) tin ions;

(b) at least one complexing agent selected from the group consisting of pyrophosphate ions, linear polyphosphate ions and cyclic polyphosphate ions;

(c) at least one stabilizing additive selected from the group consisting of nitrogen-containing organic thiol compounds; and (d) titanium (Ill) ions as reducing agent suitable to reduce tin ions to metallic tin; wherein, the at least one stabilizing additive is selected from the group consisting of compounds according to formula (I)

(I)

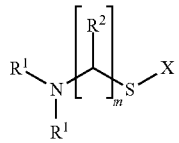

wherein m is an integer ranging from 1 to 3;

each $R^1$ is independently selected from hydrogen, alkyl group, aryl group, alkanoyl group and aroyl group;

each $R^2$ is independently selected from hydrogen, alkyl group, aryl group and carboxyl group;

X is selected from hydrogen and (Ia)

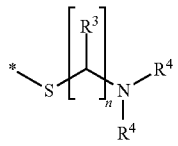

with each $R^3$ being independently selected from hydrogen, alkyl group, aryl group and carboxyl group;

each $R^4$ being independently selected from hydrogen, alkyl group, aryl group, alkanoyl group and aroyl group; and n being an integer ranging from 1 to 3; and compounds according to formula (II)

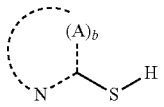

(II)

wherein each A is independently selected from the group consisting of carbon atom, nitrogen atom and sulfur atom;

b is an integer ranging from 3 to 4;

the carbon atom, all A and N in formula (II) form a substituted or unsubstituted ring; said ring is further annulated with a further ring, which is substituted or unsubstituted, saturated or unsaturated, or said ring is not annulated with any further rings;

and said ring is saturated or unsaturated.

2. The tin plating bath according to claim 1 characterized in that the substituted or unsubstituted ring comprising A and N in the compounds according to formula (II) is unsaturated.

3. The tin plating bath according to claim 1 characterized in that the substituted or unsubstituted ring formed by the carbon atom, all A and N in formula (II) is selected from the group consisting of pyrrole, imidazole, triazole, tetrazole, pyridine, pyridazine, pyrimidine, pyrazine, triazine, thiazoline, thiazole, thiazine, thiadiazole and the benzannulated derivatives of the aforementioned.

4. The tin plating bath according to claim 1 characterized in that the compounds according to formula (II) are selected from the group consisting of 2-mercaptopyridine, 2-mercaptobenzothiazole, 2-mercapto-2-thiazoline and mixtures of the aforementioned.

5. The tin plating bath according to claim 1 characterized in that the total concentration of all stabilizing additives selected from the group consisting of nitrogen-containing organic thiol compounds ranges from 0.5 to 100 mmol/L.

6. The tin plating bath according to claim 1 characterized in that the total concentration of all complexing agents selected from the group consisting of pyrophosphate ions, linear polyphosphate ions and cyclic polyphosphate ions ranges from 0.1 to 3.5 mol/L.

7. The tin plating bath according to claim 1 characterized in that the tin plating bath is free of organophosphorus compounds.

8. The tin plating bath according to claim 1 characterized in that the pH value of the tin plating bath is 7 or higher.

9. The tin plating bath according to claim 1 characterized in that the molar ratio of all complexing agents selected from the group consisting of pyrophosphate ions, linear polyphosphate ions and cyclic polyphosphate ions to the tin ions is at least 1 to 1.

* * * * *